United States Patent [19]

Pollard

[11] 4,220,305

[45] Sep. 2, 1980

[54] SUPPORTS FOR SHELVING OR THE LIKE

[76] Inventor: Ivor R. Pollard, 42 St. Johns Wood Ct., St. Johns Wood Rd., London, England

[21] Appl. No.: 964,926

[22] Filed: Nov. 30, 1978

[30] Foreign Application Priority Data

Dec. 6, 1977 [GB] United Kingdom ..... 50760/77

[51] Int. Cl.[2] ..... A47G 29/02; A47F 5/00

[52] U.S. Cl. ..... 248/245; 248/223.4

[58] Field of Search ..... 108/152; 248/223.3, 248/223.4, 224.4, 245, 247, 250

[56] References Cited

U.S. PATENT DOCUMENTS

| | | | |
|---|---|---|---|
| 1,230,999 | 6/1917 | Crist | 248/250 X |
| 2,940,718 | 6/1960 | Beal | 248/245 |
| 3,596,861 | 8/1971 | Baldini | 248/223.4 |

*Primary Examiner*—James C. Mitchell

*Attorney, Agent, or Firm*—Pearne, Gordon, Sessions

[57] ABSTRACT

A support for shelving or the like includes a load-bearing member and a mounting member formed to engage slidably in interlocking manner with a slotted mounting fixture. The load-bearing member has an end which projects through an aperture in the mounting member to abut the mounting fixture when installed and is formed slidably to engage in interlocking manner with the slotted mounting fixture.

16 Claims, 14 Drawing Figures

SUPPORTS FOR SHELVING OR THE LIKE

FIELD OF INVENTION

This invention relates to supports for shelving (or for other elongated materials such as wood or metal lengths or ducting or cable), suitable in particular for forming part of adjustable shelving, for example for books. The invention also relates to shelving assemblies comprising the supports together with complementary slotted mounting strips therefor.

BACKGROUND OF THE INVENTION AND PRIOR ART

Shelving supports are known in which a load-bearing member is fixed to a mounting member which in turn is fixed to a mounting fixture attachable for example to a wall by which shelving is to be supported. It has also been proposed to provide such supports in which the load bearing member is fixed directly to a mounting fixture without the use of an intervening mounting member. Such known and proposed constructions can have poor load-bearing strength.

OBJECT OF THE INVENTION

An object of this invention is a support for shelving or for other elongate materials which includes a load bearing member, a mounting member and a mounting fixture which cooperate to provide a support of improved load-bearing strength.

SUMMARY OF THE INVENTION

According to this invention, a support for shelving or for other elongate materials comprises a load-bearing member, and a mounting member formed to engage slidably in interlocking manner with a slotted fixture, wherein the load bearing member has an end which projects through an aperture in the mounting member to abut the mounting fixture when installed, and is also formed to engage slidably in interlocking manner with the slotted mounting fixture, e.g. a mounting strip secured to a wall by which the shelving is to be supported, which can be a short length no longer than the mounting member, if desired. I have found that certain embodiments of such a construction can give an improved load-bearing strength in comparison with a construction in which the load-bearing member is merely fixed to the mounting member without also engaging the slotted mounting fixture directly.

In a support according to the invention, the load-bearing member can have at least one lateral indentation, for example two opposite lateral indentations, therein shaped for interlocking engagement with the slotted mounted fixture at one or each edge of the slot thereof.

A support according to the invention can conveniently be made, for example, using extruded metal section for both the load bearing member and the mounting member, the end of the section forming the load-bearing member being then shaped in a suitable manner to interlock with a slotted mounting fixture, (which can also comprise an extruded metal strip) and a suitable aperture being formed in the section forming the mounting member. Suitably, for example, the load-bearing member and the mounting member can be welded or otherwise secured together to form a one-piece support for engagement with a slotted mounting fixture.

Adjustable shelving is well-known, and a number of slotted mounting strips of different shapes are available therefor. It is understood that the precise shape of the interlock between the mounting member and load bearing member can take any suitable form, according to convenience.

Suitably the load bearing member of the support can be of girder-shaped section with a downwardly-extending web (when installed) abutting against an abutting surface of the mounting member to give good rigidity and strength against load.

In one embodiment of a support according to the invention, the load-bearing member comprises an extruded metal section having a flat load-bearing surface and a reinforcing web extending perpendicularly with respect to the load-bearing surface. Suitably the load-bearing member can be approximately of T-shaped section with the reinforcing web extending through the aperture in the mounting member to abut the mounting fixture when installed. If desired, a further web can extend perpendicularly of the load-bearing surface at one edge thereof, so that in cross-section the extrusion is approximately in the form of a combined T- and L-section. Such a load-bearing member is convenient for use in supporting one end of a shelf, in which use the vertical web of the L-section acts as a retaining edge member to retain the shelf against lateral motion.

If desired, a shelf support of this embodiment of the invention can be combined with an additional trimming and/or supporting member to extend along the front edge of the supported shelf when installed, the trimming and/or supporting member comprising an extruded metal strip shaped to interlock with the end of the load bearing member opposite that which interlocks with the mounting fixture.

The trimming and/or supporting member can comprise a strip or L-section: the front (vertical) web thereof in use fronts the shelf which is supported and obviates the need for the use of finished timber for shelving; the horizontal web thereof (where present, in the case of the L-section) acts as additional support along the front edge of the shelf.

A support according to the invention can for example comprise a manually adjustable locking means, for locking the support against sliding motion in the mounting fixture when the support is located therein, e.g. a locking screw threadedly engaged in either a threaded hole in the mounting member of the support, or extending through a non-threaded hole therein and engaging a non-rotatably mounted threaded nut, and disposed (when installed and adjusted) to lock against a surface of the mounting strip.

There is however no need for the support of this invention to include such locking means; it is also contemplated to provide a stud or stop on the mounting fixture; this can be convenient for example when only a short length of slotted mounting fixture is used, e.g. to support a single shelf.

Other objects and features of the invention will become apparent from the following detailed description of preferred but non-limitative embodiments and the accompanying drawings made a part hereof and to which reference is made.

BRIEF DESCRIPTION OF THE DRAWINGS

In the drawings like numerals represent like parts.

Referring to the drawings, a support for shelving is shown attached to a wall 11 by fixing means (not shown). The support comprises a slotted vertical mounting strip 12 of extruded metal section in which a support 13 slidably and interlockingly engages. Support 13 comprises an elongate load-bearing member 14 of extruded metal section having a shaped end 15 which projects through an aperture 16 in a mounting member 17 and interlocks with the slotted strip 12 by means of notches 18 in shaped end 15. As shown in FIGS. 2 and 3, mounting member 17 also interlocks with the slotted strip 12. A stud or stop may be provided on the base of the slot in the strip 12 to abut the mounting member end, such as the web 19, engaged in the slot and thus provide positive location therefor. Conveniently the stud or stop may be formed by action of a press tool.

As shown in FIGS. 1, 3, 4 and 5, load-bearing member 14 has a downwardly extending web 19 which abuts against abutting surface 20 of mounting member 17 to give good rigidity and strength under load. An upwardly extending web 21 is also shown on load-bearing member 14; this can be omitted or placed elsewhere in shelf supports intended for supporting a long run of shelving or a multi-segment run of shelving.

Figure 1:
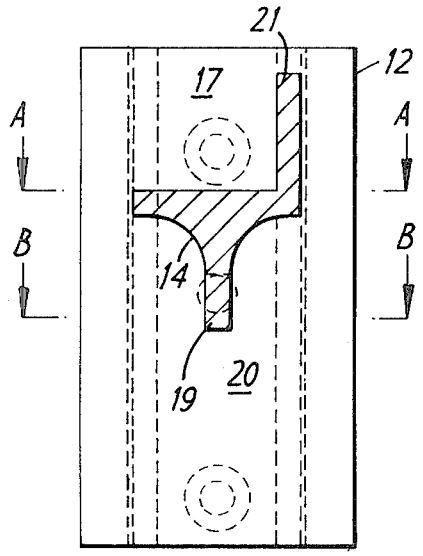
FIG. 1 is a diagrammatic front view (partly in section of a shelf support assembly incorporating a support according to an embodiment of the invention.
Figure 2:
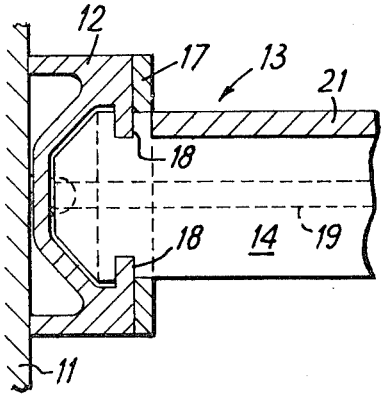
FIG. 2 is a vertical sectional view on line A—A in FIG. 1.
Figure 3:
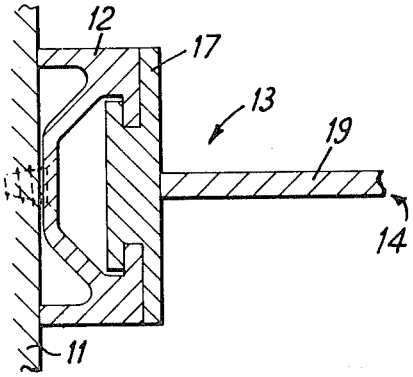
FIG. 3 is a vertical sectional view on line B—B in FIG. 1.
Figure 4:
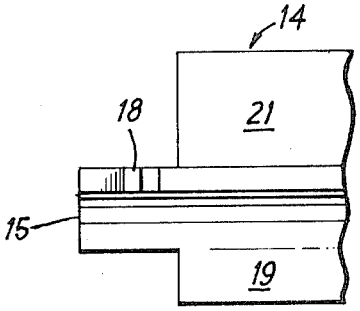
FIGS. 4 and 5 separately show the load-bearing member of the support from FIGS. 1–3 in side elevation and end elevation respectively.
Figure 5:
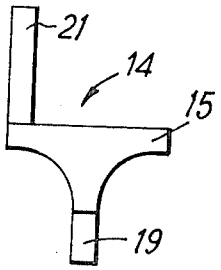
Figure 6:
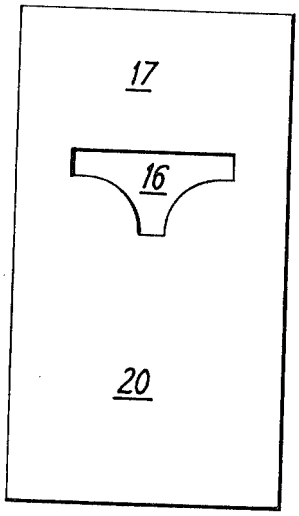
FIG. 6 separately shows the apertured mounting member of the support in view corresponding to FIG. 1.

An optional feature not shown in the drawings is for example manually adjustable locking means, e.g. a thumbscrew engaging with mounting member 17 and bearing against mounting strip 12.

Figure 7:
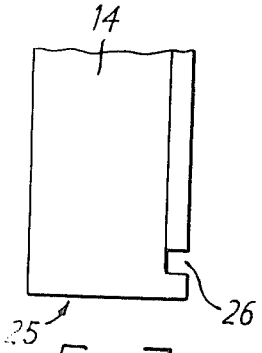
FIG. 7 shows a vertical plan view of the load bearing member of FIGS. 1–6 at the end thereof opposite to that which engages a slotted mounting strip.
Figure 8:
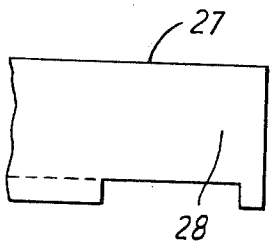
FIGS. 8–9 show in front elevation and top plan respectively a trimming and/or supporting member to interlock with the end of the load bearing member shown in FIG. 7.
Figure 9:
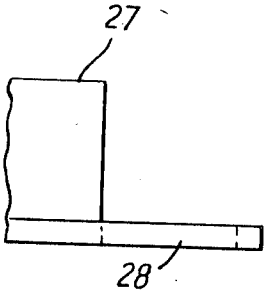

Referring to FIGS. 7–9, there is shown as an optional feature of the shelf support of FIGS. 1–6 an arrangement for providing a front trimming and supporting member for a shelf when installed.

Load-bearing member 14 has an end 25 opposite to end 15, end 25 carrying an indentation 26 to provide interlock with an L-section trimming and supporting member 27, shown in FIGS. 8 and 9. Member 27, of extruded metal section, has an end portion 28 cut away as shown in FIGS. 8 and 9 to interlock with end 25 of member 14.

The use of the shelf-supports illustrated will be appreciated without further detailed description. A shelf-support assembly comprising one of the shelf supports together with a slotted mounting strip therefor can be used to provide support for one end of a shelf of which the other end is supported by any suitable means, e.g. another such shelf-support assembly. If desired, intermediate shelf-support assemblies (but without webs 21 if not required) can be used where the run of shelf to be supported is long. Needless to say, other elongate, e.g. furniture, units, such as cupboards to be wall-mounted, can be supported by these shelf-supports.

Figure 10:
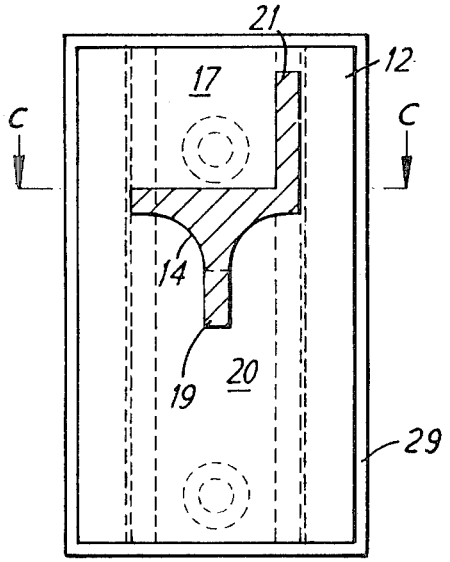
FIG. 10 is a view similar to that of FIG. 1 of a shelf support assembly incorporating a support according to another embodiment of the invention.
Figure 11:
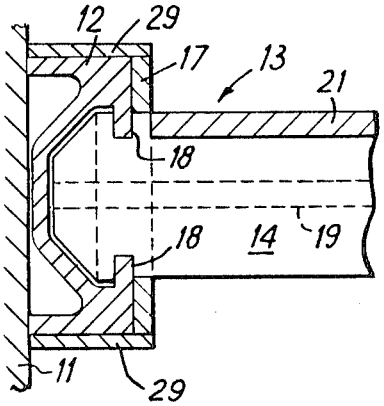
FIG. 11 is a vertical sectional view on the line C—C in FIG. 10.
Figure 12:
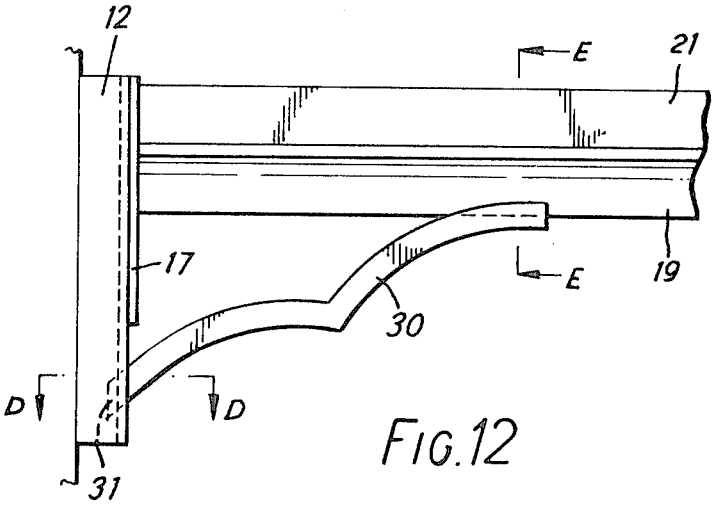
FIG. 12 is a side view of a shelf support assembly incorporating a support according to a further embodiment of the invention including a strut.
Figure 13:
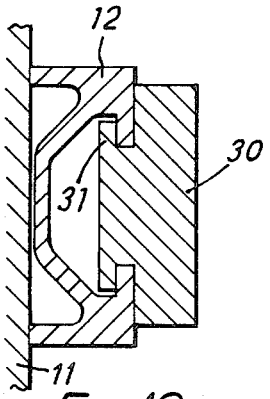
FIG. 13 is a vertical sectional view on line D—D in FIG. 12.
Figure 14:
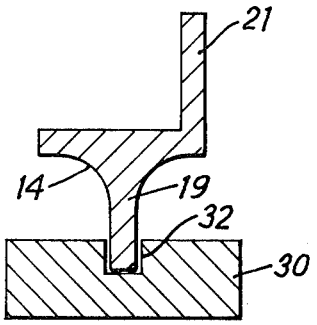
FIG. 14 is a horizontal sectional view on line E—E in FIG. 12.

In another embodiment of a shelf support according to the invention as shown in FIGS. 10 and 11, in which the mounting member 17 is substantially equal in length to the slotted mounting fixture 12, it can be convenient and desirable to retain the mounting member 17 against sliding motion relative to the fixture 12, and to provide an aesthetically desirable concealment of the construction of the mounting arrangement; by providing an apertured cover or surround 29, for example a rectangular frame of bent metal strip, as a close fit around at least side surfaces of the assembled mounting member and slotted mounting fixture. In such a case it is then possible to dispense with other means, (for example the stud or stop described above) for retaining the mounting member against sliding motion.

Where the support of the invention is to be used with a long load-bearing member 14 it is preferable to provide a diagonal supporting strut such as 30 shown in FIGS. 12, 13 and 14 intermediate the ends of the member 14. The strut 30 can be of any convenient elongate shape and one end 31 is of notched shape to interlock with the slotted strip mounting fixture 12 as shown in FIG. 12. This end 31 is shaped to bear against the strip 12 under load and may be positively located in the strip 12 by abutment with stops or studs (not shown) provided in the strip 12.

Although shown in FIGS. 12 and 13 as directly abutting the outer surface of the strip 12, the strut 30 may pass through a correspondingly shaped aperture in the mounting member 17 into the strip 12 and thus abut the outer surface of the member 17.

The end of the strut 30 remote from the end 31 is arranged to contact the member 14 at a location intermediate the ends of the member 14. Such contact may be by means of a groove 32 provided in the strut 30 to accommodate the web 19 of the member 14 as shown in FIG. 14 or may alternatively be by means of a notch (not shown) cut in the web 19, into which notch is fitted the adjacent end of the web 19.

I claim:

1. A support for shelving or for other elongate materials, comprising a load-bearing member, and a mounting member each of which is adapted to engage slidably in interlocking manner with a slotted mounting fixture, wherein the load-bearing member has an end which projects through an aperture in the mounting member to abut the mounting fixture when installed, and is also adapted to engage slidably in interlocking manner with the slotted mounting fixture.

2. A support according to claim 1, wherein the load-bearing member has at least one lateral indentation shaped for interlocking engagement with the slotted mounting fixture at an edge of the slot thereof.

3. A support according to claim 2, wherein the load-bearing member has two opposite lateral indentations therein shaped for interlocking engagement with the slotted mounted fixture at each edge of the slot thereof.

4. A support according to claim 1, 2 or 3, in which the end of the load bearing member and the mounting member each comprise an extruded metal section.

5. A support according to claim 1, 2 or 3, in which the load-bearing member comprises an extruded metal section having a flat load-bearing surface and a reinforcing web extending perpendicularly with respect to the load-bearing surface.

6. A support according to claim 5, in which the load-bearing member is approximately of T-shaped section with the reinforcing web extending through the aperture in the mounting member to abut the mounting fixture when installed.

7. A support according to claim 5, in which a further web extends perpendicularly of the load-bearing surface at one edge thereof, and wherein in cross-section the extrusion is approximately in the form of a combined T- and L-section.

8. A support according to claim 4, further comprising a trimming and supporting member to extend along a front edge of a supported shelf when the support is installed, comprising an extruded metal strip shaped to interlock with the end of the load-bearing member opposite that which interlocks with the mounting fixture.

9. A support according to claim 8, in which the trimming and supporting member comprises an extruded strip or L-section.

10. A support according to claim 1, which includes manually adjustable locking means for locking the support against sliding motion in the mounting fixture when the support is located therein.

11. A support assembly suitable for shelvimg according to claim 1, together with a complementary slotted mounting fixture therefor.

12. A support assembly according to claim 11, in which the complementary slotted mounting fixture has a stud or stop disposed to retain the support against sliding movement.

13. A support according to claim 12, in which the load bearing member is approximately of T-shaped section with the reinforcing web extending through the aperture in the mounting member to abut the mounting fixture when installed, and in which the stud or stop of the mounting fixture is placed so as to retain the support against downward sliding movement by abutment of the reinforcing web.

14. A support assembly according to claim 12 or 13, in which the complementary slotted mounting fixture is formed of extruded metal section and the stud or stop has been formed by action of a press tool thereon.

15. A support assembly according to claim 11 or 12, in which the mounting member is substantially equal in length to the slotted mounting fixture, and including an apertured surround for fitting closely around at least side surfaces of the assembled mounting member and slotted mounting fixture.

16. A support assembly according to claim 1, including an elongate supporting strut having one end of notched shape such as to interlock with the slotted mounting fixture and the other end shaped to engage the load bearing member intermediate its ends.

* * * * *